US008362696B2

(12) United States Patent
Zheng

(10) Patent No.: US 8,362,696 B2
(45) Date of Patent: Jan. 29, 2013

(54) LED DISPLAY SCREEN ASSEMBLY

(76) Inventor: Zhongliang Zheng, Hangzhou (CN)

( * ) Notice: Subject to any disclaimer, the term of this patent is extended or adjusted under 35 U.S.C. 154(b) by 415 days.

(21) Appl. No.: 12/582,695

(22) Filed: Oct. 20, 2009

(65) Prior Publication Data

US 2011/0089824 A1 Apr. 21, 2011

(51) Int. Cl.

| | |
|---|---|
| ***H01J 1/62*** | (2006.01) |
| ***F21V 21/00*** | (2006.01) |
| ***F21V 3/00*** | (2006.01) |
| ***G09F 13/08*** | (2006.01) |

(52) U.S. Cl. ..... 313/512; 362/249.02; 362/97.3; 362/311.02

(58) Field of Classification Search ..... None
See application file for complete search history.

(56) References Cited

U.S. PATENT DOCUMENTS

| | | | | |
|---|---|---|---|---|
| 5,390,093 | A * | 2/1995 | Himeno et al. | 362/249.06 |
| 7,403,241 | B2 * | 7/2008 | Park | 349/58 |
| 7,854,527 | B2 * | 12/2010 | Anderson | 362/133 |

* cited by examiner

*Primary Examiner* — Anh Mai
*Assistant Examiner* — Britt D Hanley

(57) ABSTRACT

A LED display screen includes a case, a main board, and a plurality of LED display modules. The case has a front surface, a rear surface, and an opening provided between the front surface and the rear surface. The front surface has a window. The main board is inserted into the case via the opening, and has a front surface for displaying via the window. Each of the LED display module includes a LED display unit, a PCB driving board, and a supporting base. The LED display unit is connected electrically with the PCB driving board. The LED display unit mounts on the supporting base. The PCB driving board mounts on the supporting base. The PCB driving board is held between the LED display unit and the supporting base. The LED display modules mounts in formation on the front surface of the main board to form a united display screen.

15 Claims, 13 Drawing Sheets

LED DISPLAY SCREEN ASSEMBLY

BACKGROUND OF THE PRESENT INVENTION

1. Field of Invention

The present invention relates to a LED display screen, and more particularly to a LED display screen which is assembled with multiple standardized LED modules.

2. Description of Related Arts

It is a time of information and attention. As an efficient medium to transfer information and idea to people, LED display screens are widely used in many circumstances. We can see LED display screen in streets, on buses, in stadium, and even in toilet. Accordingly, assembling LED display screens becomes a usual and important task.

A traditional LED display screen is shown in FIG. 1A-1C, ordinarily including a display module including a plurality of LED display units, and a PCB board. The LED display units mount on the PCB board one by one, and electrically connect with the PCB board. The PCB board supports the LED display units and supplies electric power to them. The LED display screen may further include a case for receiving the display module to fix and protect the PCB board from being damaged by rain or wind.

However, there are some drawbacks of the traditional LED display screens. The shape and size of PCB board is whole and unchangeable, so the screens can only be used in particular circumstances. It is inconvenient to change display effect of the screens, especially in temporary situations such as parties, evenings, and matches. The places usually use large display screens for once, but due to the unchangeable shape and size of the screens, it is hard for the screens to be used in other occasions. What's more, because the display screens are a whole, it is difficult to deliver the big fragile display screens. Therefore, people must produce display screens of different sizes and shapes to meet different requirements, and after using, the display screens are laid idle. On the other hand, the PCB board has electric circuit, if the electric circuit is damaged, the whole PCB board should be replaced. In the traditional LED display screens, the PCB board supports the LED display unit directly, and therefore is easy to be damaged while assembling and disassembling. Additionally, the case holds edge portions of the PCB board to fix the PCB board and the LED display unit. Because the size and shape of the LED display unit and the PCB board is unchangeable, the case must be made to adapt to the edge portions. In a word, the traditional LED display screens are individual and rigid, and can not be adjusted or used freely.

SUMMARY OF THE PRESENT INVENTION

An object of the present invention is to provide a LED display screen assembly, which is picture puzzle-styled, and is capable of adjusting the size and the shape thereof, so as to provide various display effects to meet different requirement in different situations.

Another object of the present invention is to provide a LED display screen assembly, which is suitable for temporary occasions such as parties, evenings, and matches. The LED display screen can be assembled conveniently, and after using, it can be disassembled and delivered to the next place.

Another object of the present invention is to provide a LED display screen assembly, which is durable, has long service, protects fragile LED display unit from damage and facilitates delivery.

Another object of the present invention is to provide a LED display screen assembly, which is capable of providing an irregular display effect, so as to distinguish from the traditional square screens.

Another object of the present invention is to provide a LED display screen assembly, which avoids supporting the LED display unit directly on the PCB board so as to protect the PCB board.

Another object of the present invention is to provide a LED display screen assembly, which is modular, so it is easy to repair or replace the damaged LED display unit or electric circuit.

Another object of the present invention is to provide a LED display screen assembly, which is conveniently assembled up to provide various display effect and facilitate delivery.

Another object of the present invention is to provide a method of assembling a LED display screen, which is easy and reliable, can assemble the LED display screen quickly, and can be maintained conveniently.

Accordingly, in order to accomplish the above objects, the present invention provides a LED display screen assembly, comprising:

a case having a front surface having a window, a rear surface, and an opening provided between the front surface and the rear surface;

a main board for inserting into the case via the opening, having a front surface for displaying via the window; and a plurality of LED display modules each comprising a LED display unit for illuminating, a PCB driving board electrically connecting with the LED display unit, and a supporting base for mounting on the main board, wherein the PCB driving board mounts on the supporting base, the LED display unit mounts on the supporting base and holds the PCB driving board therebetween, wherein the LED display modules mount on the front surface of the main board in formation to form a united display screen.

These and other objectives, features, and advantages of the present invention will become apparent from the following detailed description, the accompanying drawings, and the appended claims.

DETAILED DESCRIPTION OF THE PREFERRED EMBODIMENT

Figure 1A:
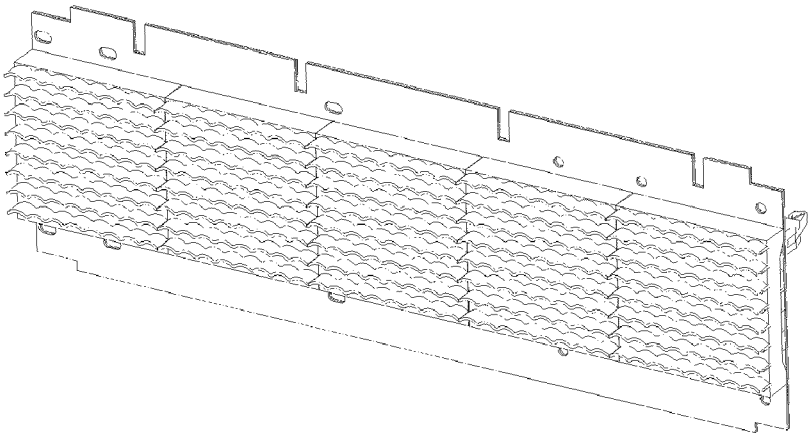
FIG. 1A is a front perspective view of a display module according to the prior art.
Figure 1B:
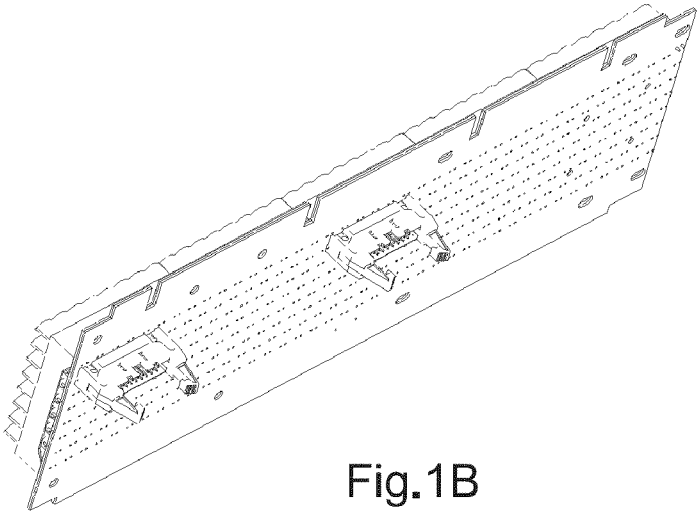
FIG. 1B is a back perspective view of the display module according to the prior art.
Figure 1C:
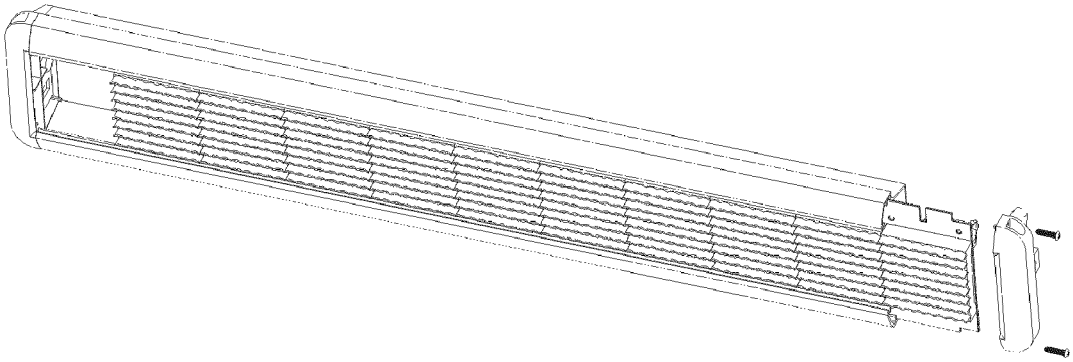
FIG. 1C is a perspective view of a LED display screen according to the prior art.
Figure 2A:
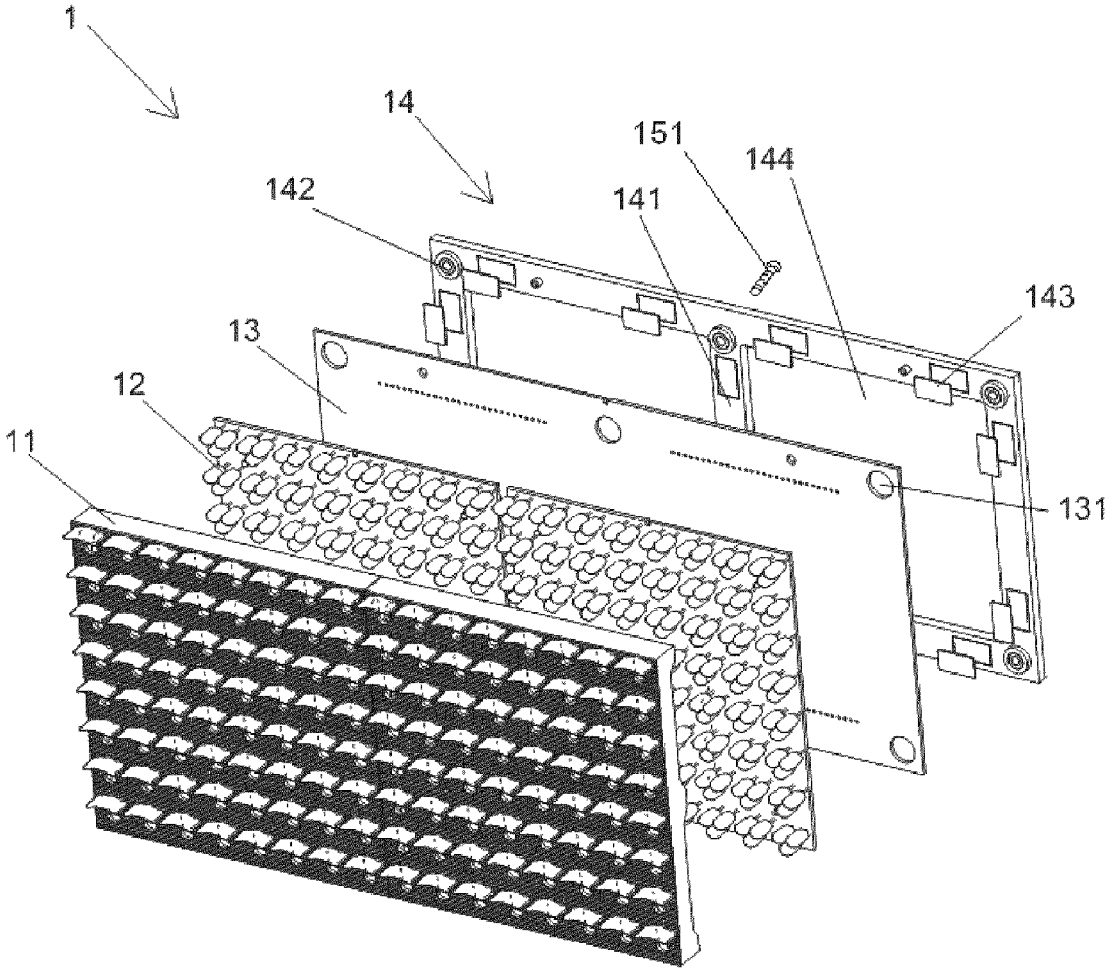
FIG. 2A is a front exploded view of a LED display module of a LED display screen assembly according to a first preferred embodiment of the present invention.
Figure 2B:
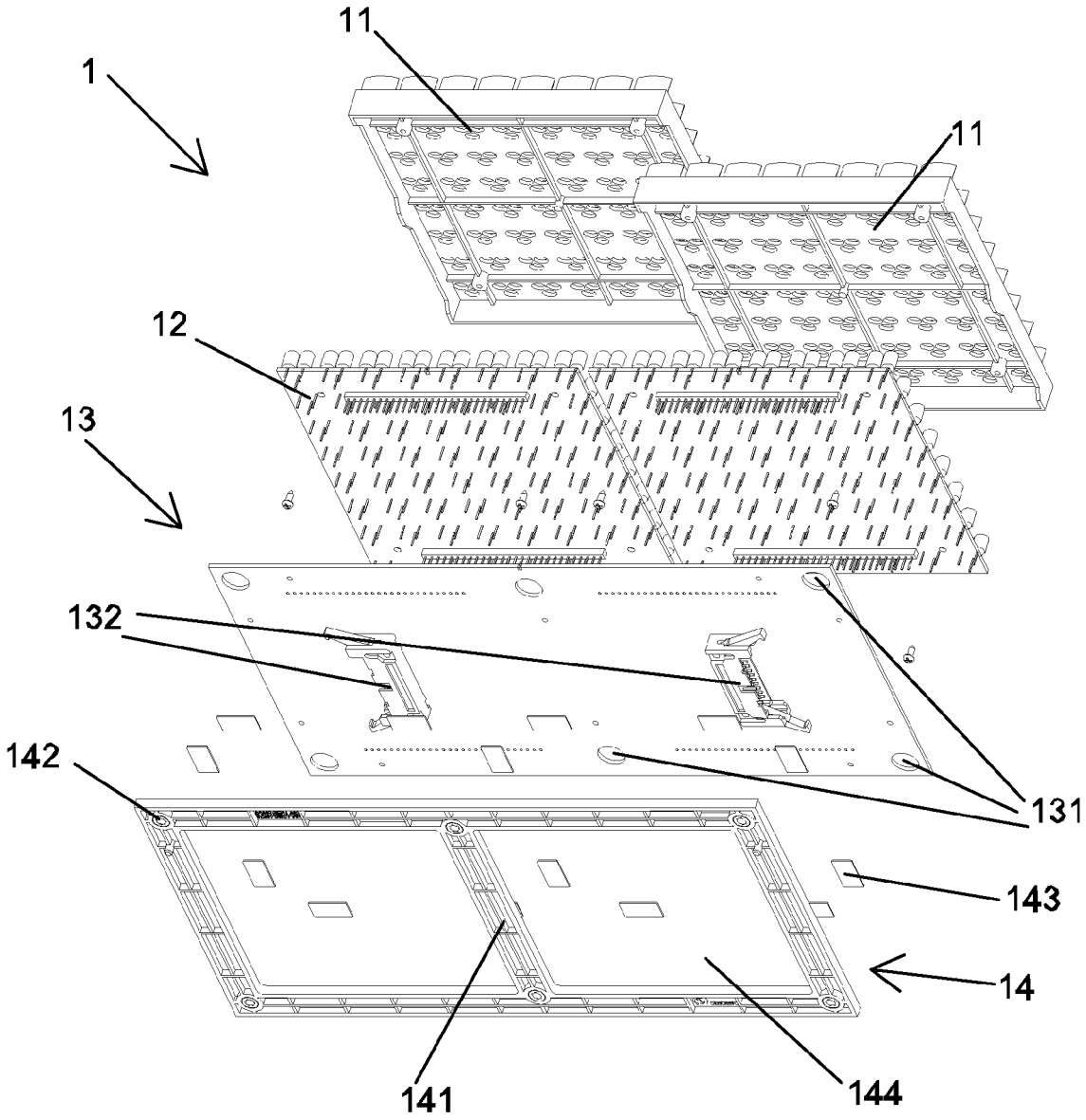
FIG. 2B is a back exploded view of the LED display module of the LED display screen assembly according to the first preferred embodiment of the present invention.
Figure 2C:
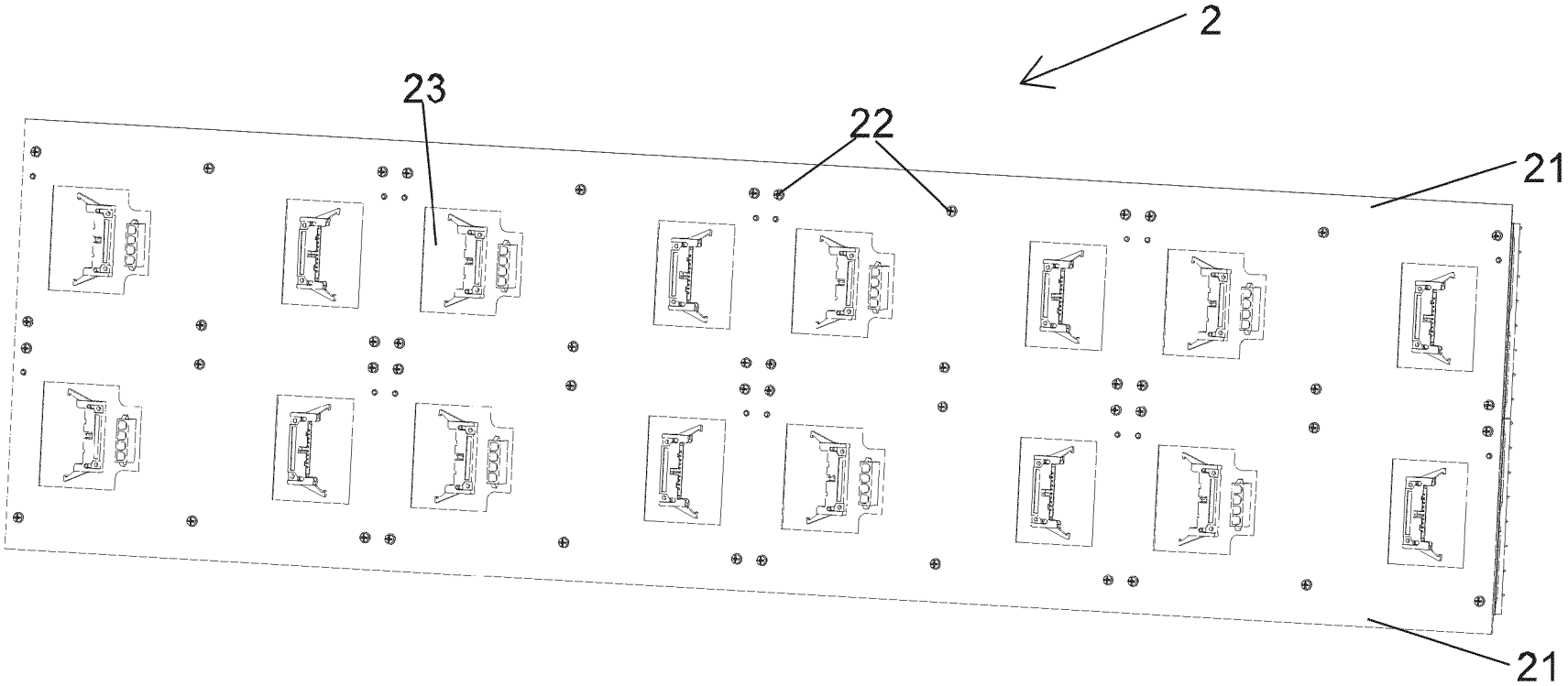
FIG. 2C is a back perspective view of an main board of the LED display screen assembly when assembling according to the first preferred embodiment of the present invention.
Figure 2D:
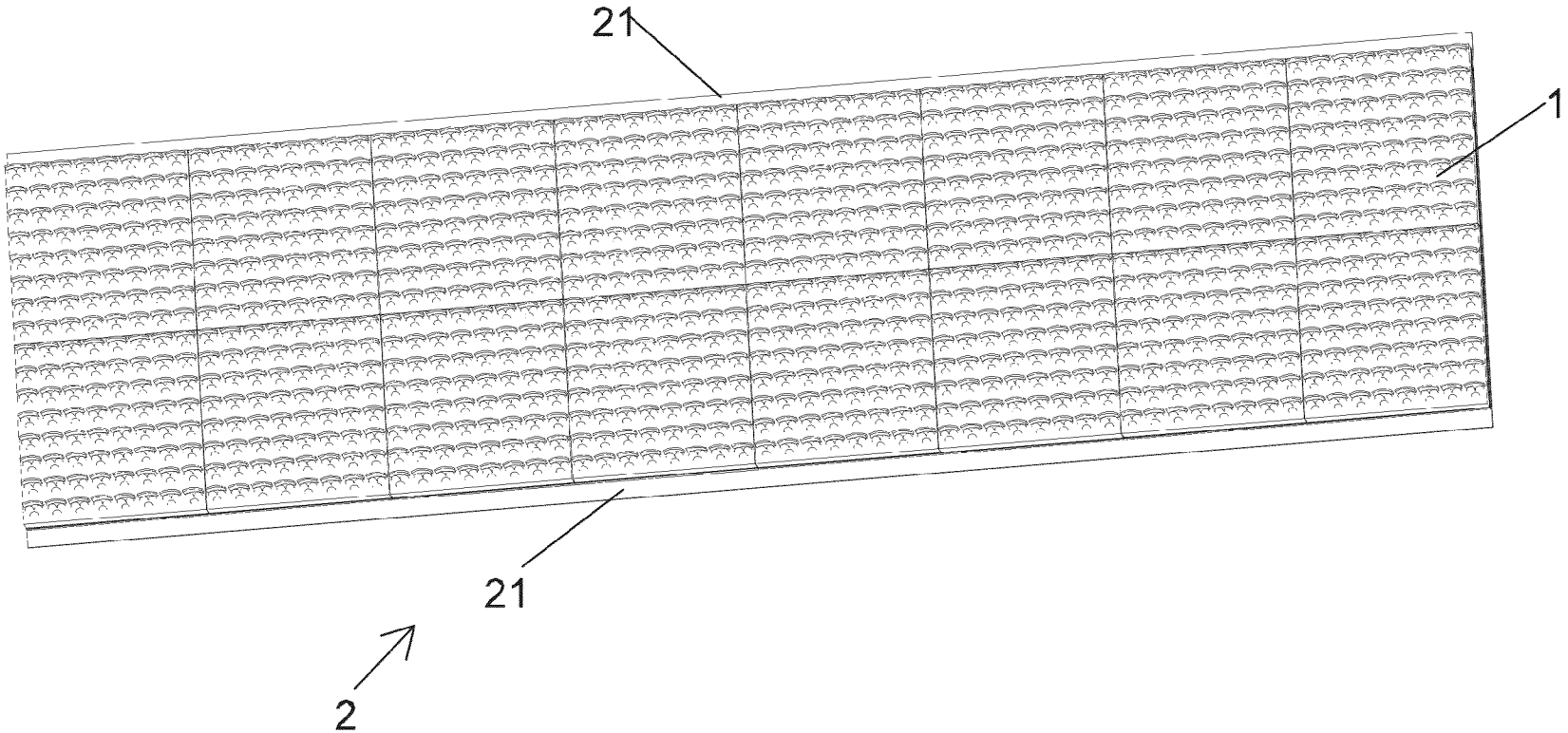
FIG. 2D is a front perspective view of the main board of the LED display screen assembly when assembling according to the first preferred embodiment of the present invention.
Figure 2E:
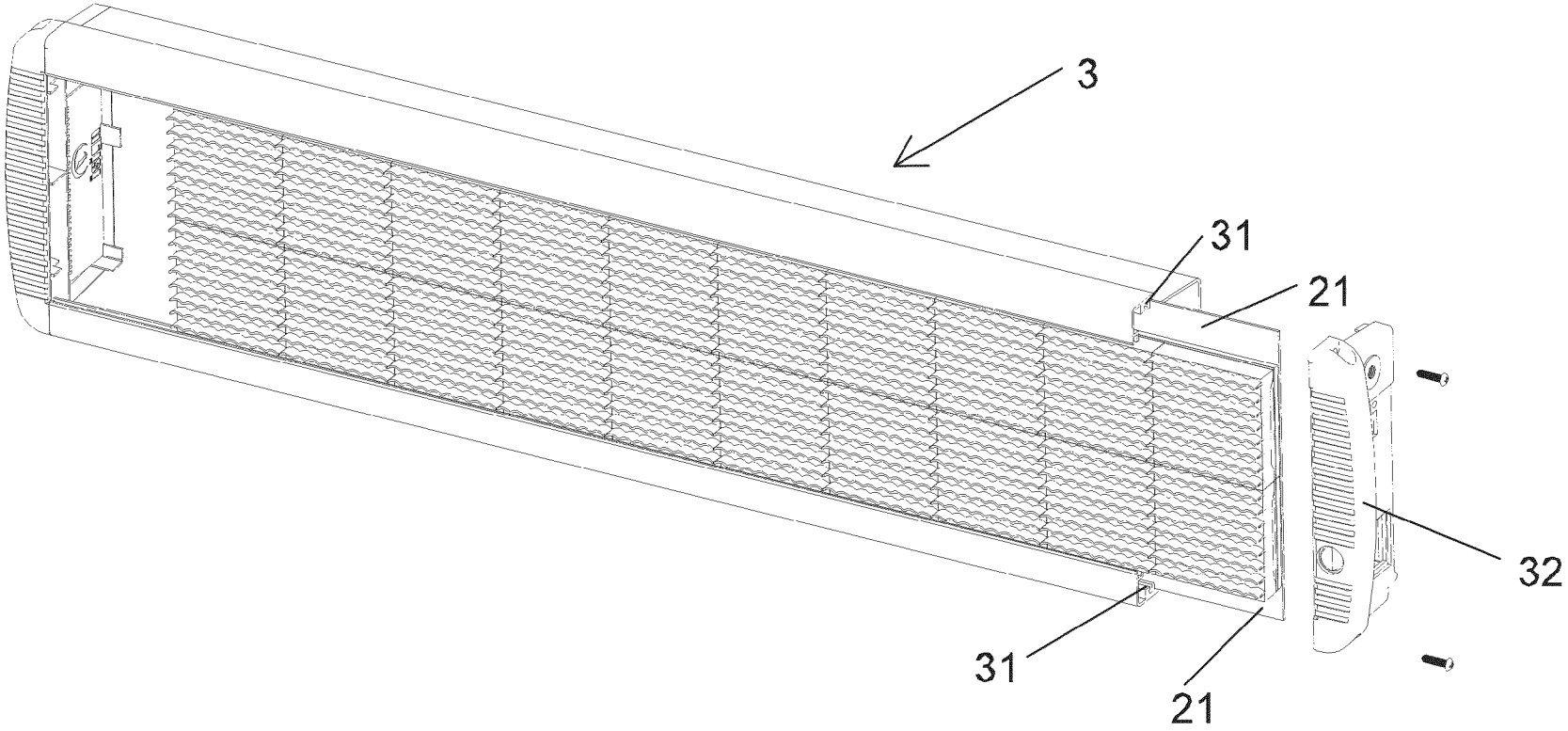
FIG. 2E is a perspective view of the LED display screen assembly when assembling according to the first preferred embodiment of the present invention.
Figure 3A:
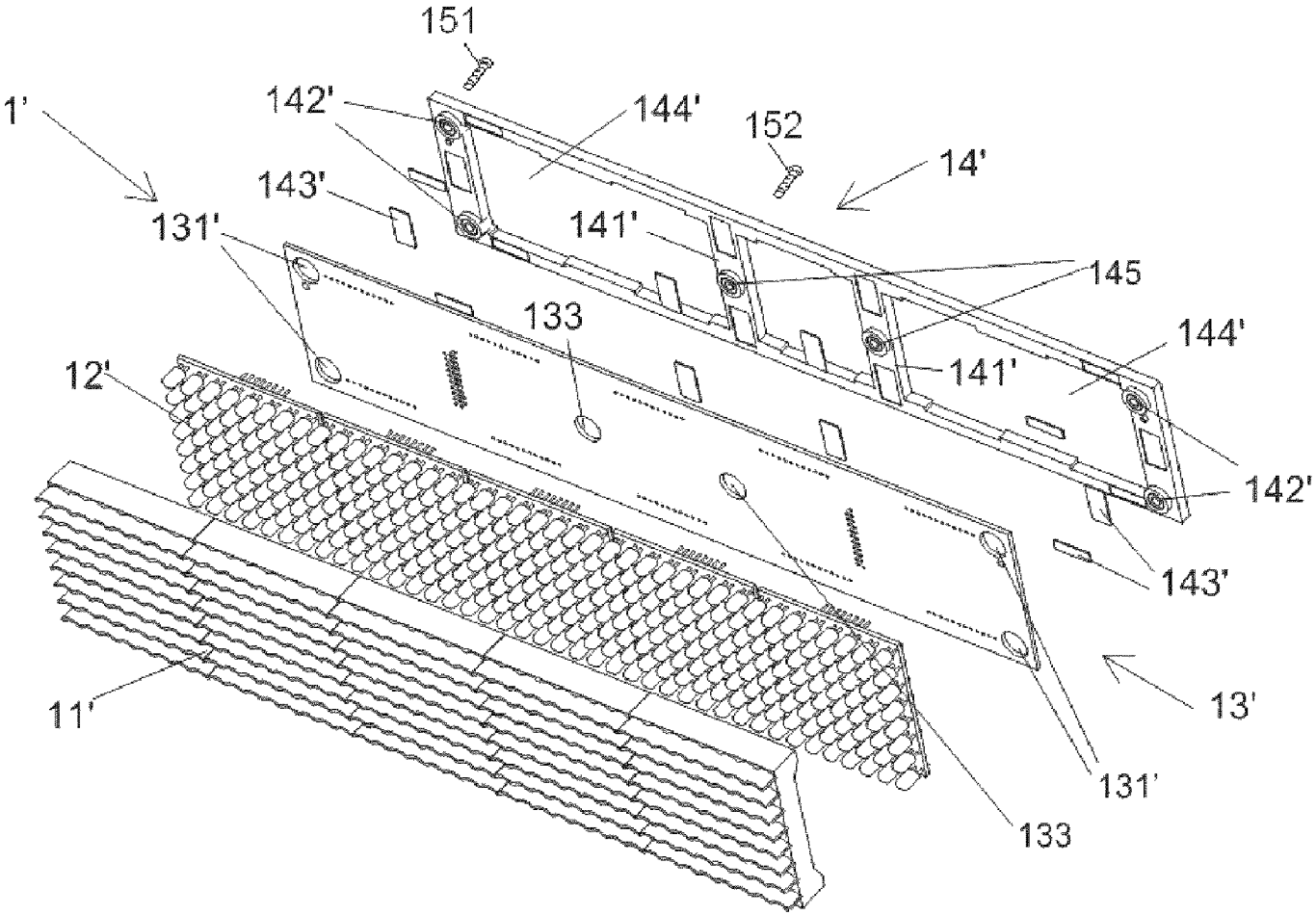
FIG. 3A is a front exploded view of a LED display module of a LED display screen assembly according to a second preferred embodiment of the present invention.
Figure 3B:
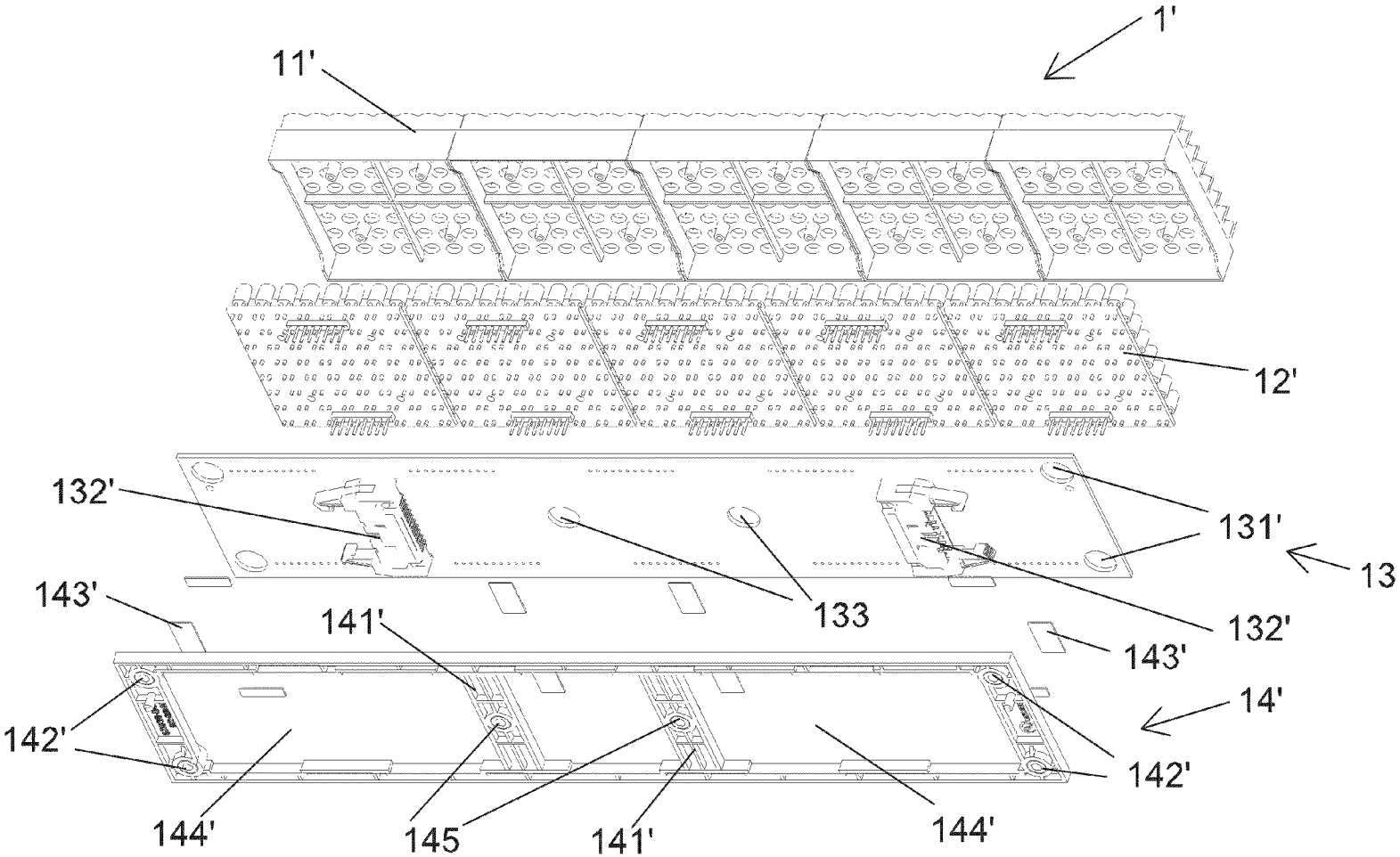
FIG. 3B is a back exploded view of the LED display module of the LED display screen assembly according to the second preferred embodiment of the present invention.
Figure 3C:
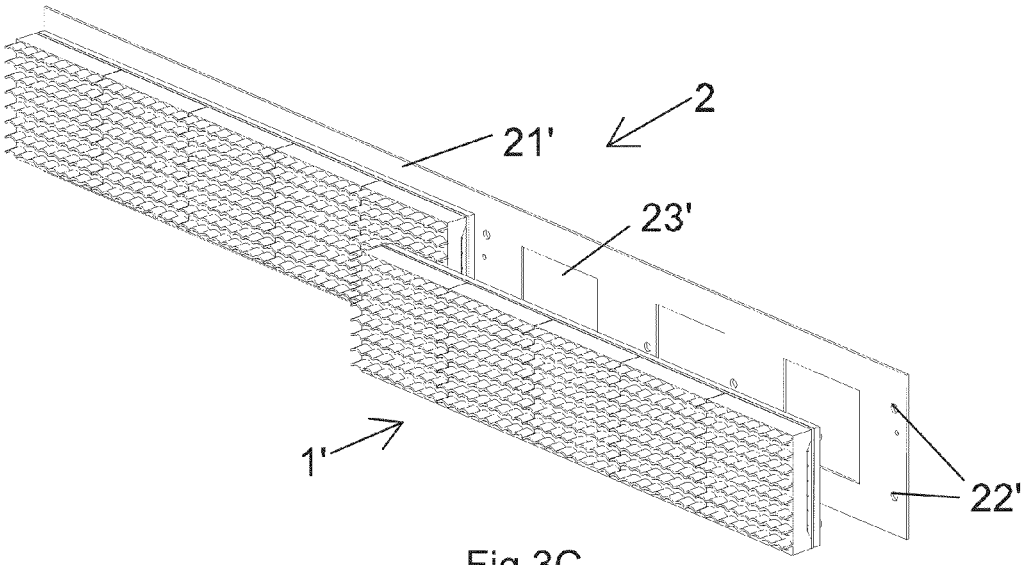
FIG. 3C is a front perspective view of an main board of the LED display screen assembly when assembling according to the second preferred embodiment of the present invention.
Figure 3D:
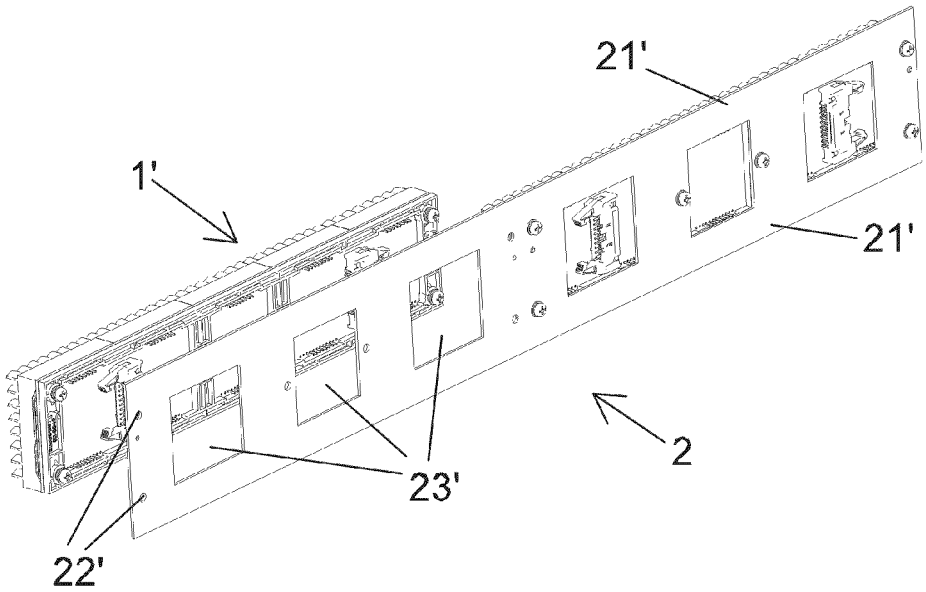
FIG. 3D is a back perspective view of the main board of the LED display screen assembly when assembling according to the second preferred embodiment of the present invention.
Figure 3E:
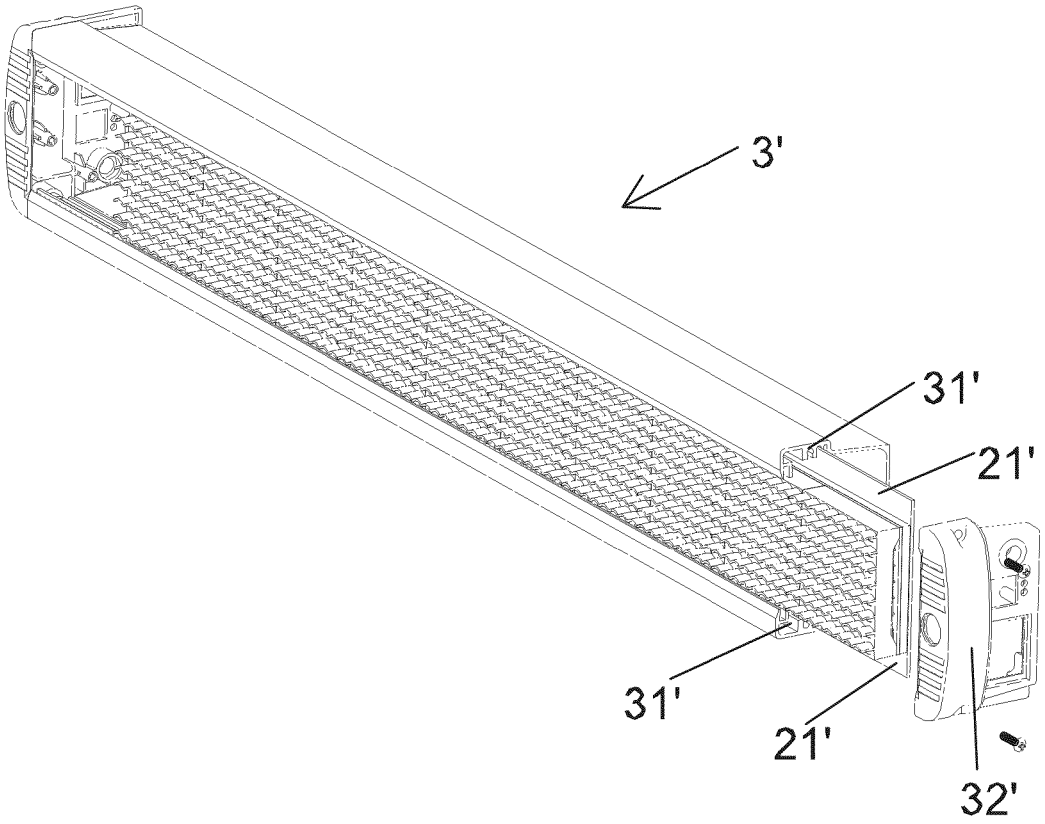
FIG. 3E is a perspective view of the LED display screen assembly when assembling according to the second preferred embodiment of the present invention.

Referring to FIG. 2A-2E of the drawings, a LED display screen assembly according to a first preferred embodiment of the present invention is illustrated, comprising a case 3, a main board 2, and a plurality of LED display modules 1.

The case 3 has a front surface, a rear surface, and an opening provided between the front surface and the rear surface. The front surface has a window.

The main board 2 is inserted into the case 3 via the opening, and has a front surface for displaying via the window.

Each of the LED display module 1 comprises a LED display unit 12, a PCB driving board 13, and a supporting base 14. The LED display unit 12 is connected electrically with the PCB driving board 13. The LED display unit 12 mounts on the supporting base 14. The PCB driving board 13 mounts on the supporting base 14. The PCB driving board 13 is held between the LED display unit 12 and the supporting base 14. The LED display modules 1 mounts in formation on the front surface of the main board 2 to form a united display screen.

The modular LED display screen assembly according to the present invention makes that assembling the LED display screen becomes easy and convenient. People just need to determine a size of the main board 2 and a shape of the united display screen, then choose appropriate number of the LED display module 1 to assemble on the main board 2 and form the united display screen. After using, especially in temporary occasions such as parties, evenings and matches, the LED display modules 1 can be disassembled from the main board 2 and then deliver the LED display modules 1 and the main board 2 separately. Therefore, the LED display screen assembly can be reused in many occasions, so as to greatly reduce cost and avoid waste.

It is worth mentioning that the united display screen can be various shapes, such as traditional square, letter-shaped, number-like, polygonal, animal-like, and cloud. The LED display screen is used to present various and wonderful world, so why the shape of the LED display screen must be the same? Besides, if one of the LED display modules 1 is damaged, the whole LED display screen assembly keeps working, and can be easily repaired by replacing the damaged LED display module 1.

Additionally, since the LED display units 12 mount on the main board 2 instead of the PCB driving board 13, the PCB driving board 13 will not be damaged easily by weight of the LED display units 12. Especially when a large united display screen is needed, the LED display units 12 mounting on the main board 2 are more safe and convenient.

According to the present invention, the PCB driving board 13 has a controlling port 132 provided on an opposite side to the LED display unit 12 and electrically connecting with the LED display unit 12 to provide electric power and control a working of the LED display unit 12.

The PCB driving board 13 has a plurality of first holes 131 provided along edge portions thereof. The supporting base 14 has a plurality of second holes 142 corresponding to the first holes 131. The main board 2 has a plurality of third holes 22 corresponding to the second holes 142. The LED display unit 12 further comprises a plurality of first bolts 151 corresponding to the first holes 131, the second holes 142 and the third holes 22. The first bolts 151 insert through the first holes 131, the second holes 142 and the third holes 22 to combine the PCB driving board 13, the supporting base 14 and the main board 2 up. Preferably, the first holes 131 are on corners and middles of edges of the PCB driving board 13.

The LED display unit 12 further comprises a plurality of buffers 143 mounting besides the first bolts 151, and between the PCB driving board 13 and the supporting base 14, so as to reduce pressure force therebetween when fastening the first bolts 151, and protect the PCB driving board 13 from being damaged.

The supporting base 14 further comprises a first bridge 141 mounting on a central portion thereof. The first bridge 141 reserves two blank areas 144 respectively on two sides thereof. The main board 2 has corresponding blank windows 23 for overlapping with the blank areas 144 to expose the controlling port 132 to outer devices. The first bridge 141 strengthens the supporting base 14 to prevent transformation, so as to provide a flat and stable supporting base 14.

Preferably, the main board 2 has two guiding edge portions 21 respectively provided on two opposite sides. The case 3 has two guiding grooves 31 respectively provided on two opposite sides beside the opening and between the front surface and the rear surface of the case 3. The main board 2 is received into the case 3 by inserting the guiding edge portions 21 along the guiding grooves 31 via the opening. The guiding grooves 31 hold the guiding edge portions 21 to mount the main board 2 inside the case 3.

The LED display modules 1 is protected within the case 3 by simply inserting the main board 2 into the opening. Therefore, it is convenient to assemble or disassemble the LED display screen assembly. Besides, a size of the single LED display unit 12 is certain, and the main board 2 is made to adapt for the LED display unit 12 and reserves a predetermined size of the guiding edge portions 21 for matching with the case 3, so the case 3 and the main board 2 is standardized to be applied widely.

The case 3 further comprises a retaining member 32 corresponding to the opening. The retaining member 32 mounts on the opening after inserting the main board 2 into the case 3 to retain the main board 2 inside the case 3. Therefore, assembling the main board 2 into the case 3 comprises simply inserting and closing.

According to the present invention, the main board 2 is preferably made of aluminium alloy, such that the main board 2 is easy to be manufactured to meet different requirements, besides, a weight of the main board 2 is reduced, and the main board 2 resists rust.

Preferably, the supporting base 14 is made of plastic. Plastic is light, and is capable of absorbing shake, so as to protect the LED display units 12 and the PCB driving board 13.

The LED display module 1 further comprises a transparent LED shade 11. The LED shade 11 covers on the LED display unit 12 to protect the LED display unit 12 from rain, dust or wind.

Referring to FIG. 3A-3E of the drawings, a LED display screen assembly according to a second preferred embodiment of the present invention is illustrated, which is prolonged as comparing to the first preferred embodiment, and has similar structure with the first preferred embodiment except the connecting manners.

The LED display screen assembly comprises a case 3', a main board 2', and a plurality of LED display modules 1'.

The case 3' has a front surface, a rear surface, and an opening provided between the front surface and the rear surface. The front surface has a window.

The main board 2' is inserted into the case 3' via the opening, and has a front surface for displaying via the window.

Each of the LED display module 1' comprises a LED display unit 12', a PCB driving board 13', and a supporting base 14'. The LED display unit 12' is connected electrically with the PCB driving board 13'. The LED display unit 12' mounts on the supporting base 14'. The PCB driving board 13' mounts on the supporting base 14'. The PCB driving board 13' is held between the LED display unit 12' and the supporting base 14'. The LED display modules l' mounts in formation on the front surface of the main board 2' to form a united display screen.

According to the present invention, the PCB driving board 13' has a controlling port 132' provided on an opposite side to the LED display unit 12' and electrically connecting with the LED display unit 12' to provide electric power and control a working of the LED display unit 12'.

The PCB driving board 13' has a plurality of first holes 131' provided along edge portions thereof. The supporting base 14' has a plurality of second holes 142' corresponding to the first holes 131'. The main board 2' has a plurality of third holes 22' corresponding to the second holes 142'. The LED display unit 12' further comprises a plurality of first bolts 151 corresponding to the first holes 131', the second holes 142' and the third holes 22'. The first bolts 151 insert through the first holes 131', the second holes 142' and the third holes 22' to combine the PCB driving board 13', the supporting base 14' and the main board 2' up. Preferably, the first holes 131' are on corners and middles of edges of the PCB driving board 13'.

The LED display unit 12' further comprises a plurality of buffers 143' mounting besides the first bolts 151, and between the PCB driving board 13' and the supporting base 14', so as to reduce pressure force therebetween when fastening the first bolts 151, and protect the PCB driving board 13' from being damaged.

The supporting base 14' has a plurality of fourth holes 133 provided evenly in a middle portion and along two prolonged edges thereof. The supporting base 14' further comprises a plurality of second bridges 141' mounting evenly in a middle portion and along two prolonged edges thereof. The second bridges 141' has a plurality of fifth holes 145 corresponding to the fourth holes 133. The LED display unit 12' further comprises a plurality of second bolts 152 corresponding to the fourth holes 133 and the fifth holes 145. The second bolts 152 insert through the fourth holes 133 and the fifth holes 145 to combine the PCB driving board 13' and the supporting base 14' up. Therefore, the second bolts 152 fasten the PCB driving board 13' and the supporting base 14' from a heart thereof.

The second bridge reserves blank areas 144' respectively therebetween. The main board 2' has corresponding blank windows 23' for overlapping with the blank areas 144' to expose the controlling port 132' to outer devices. The second bridge strengthens the supporting base 14' to prevent transformation, so as to provide a flat and stable supporting base 14'.

Figure 4A:
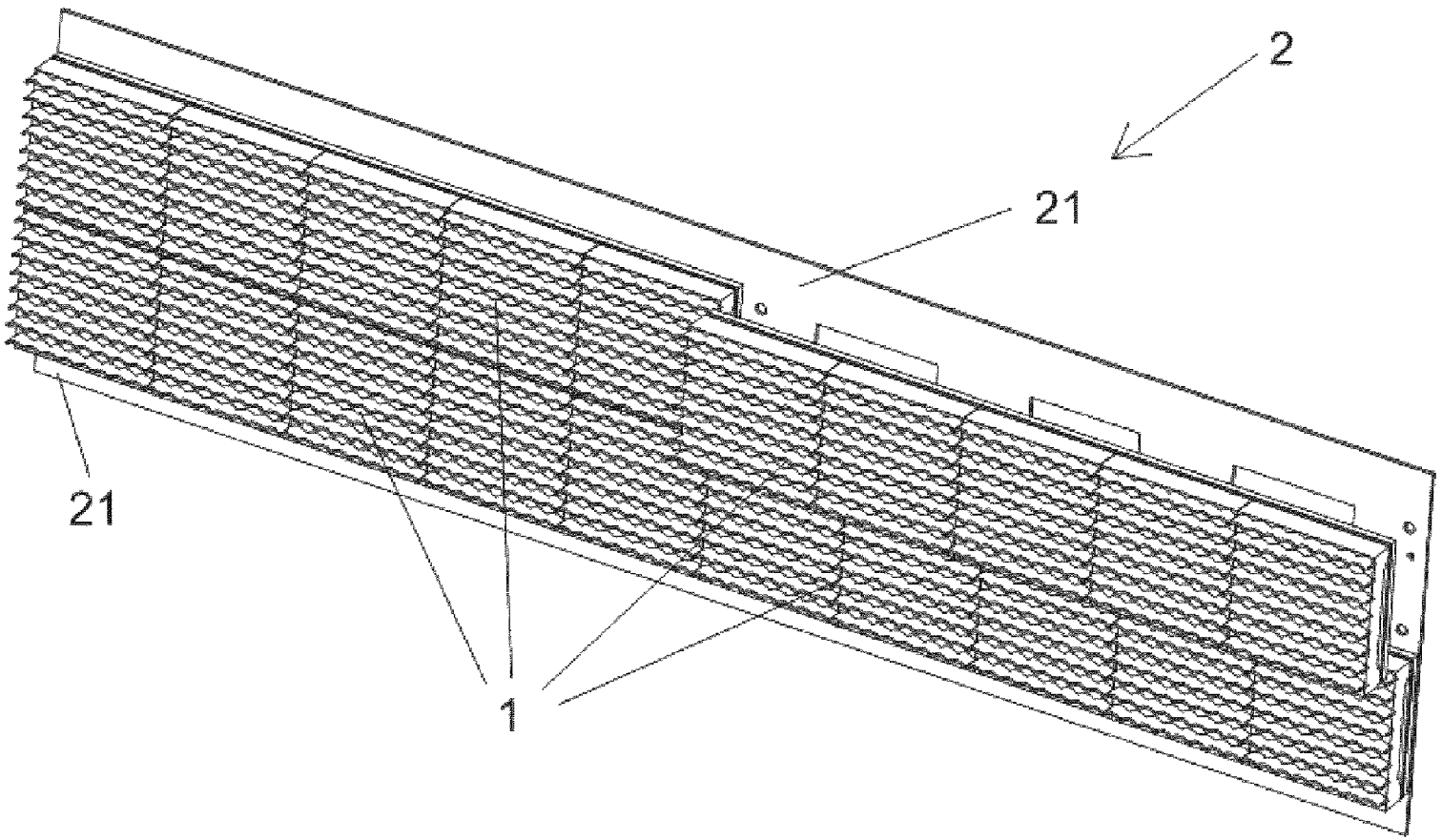
FIG. 4A is a front perspective view of the main board of the LED display screen assembly when assembling according to the first preferred embodiment of the present invention.
Figure 4B:
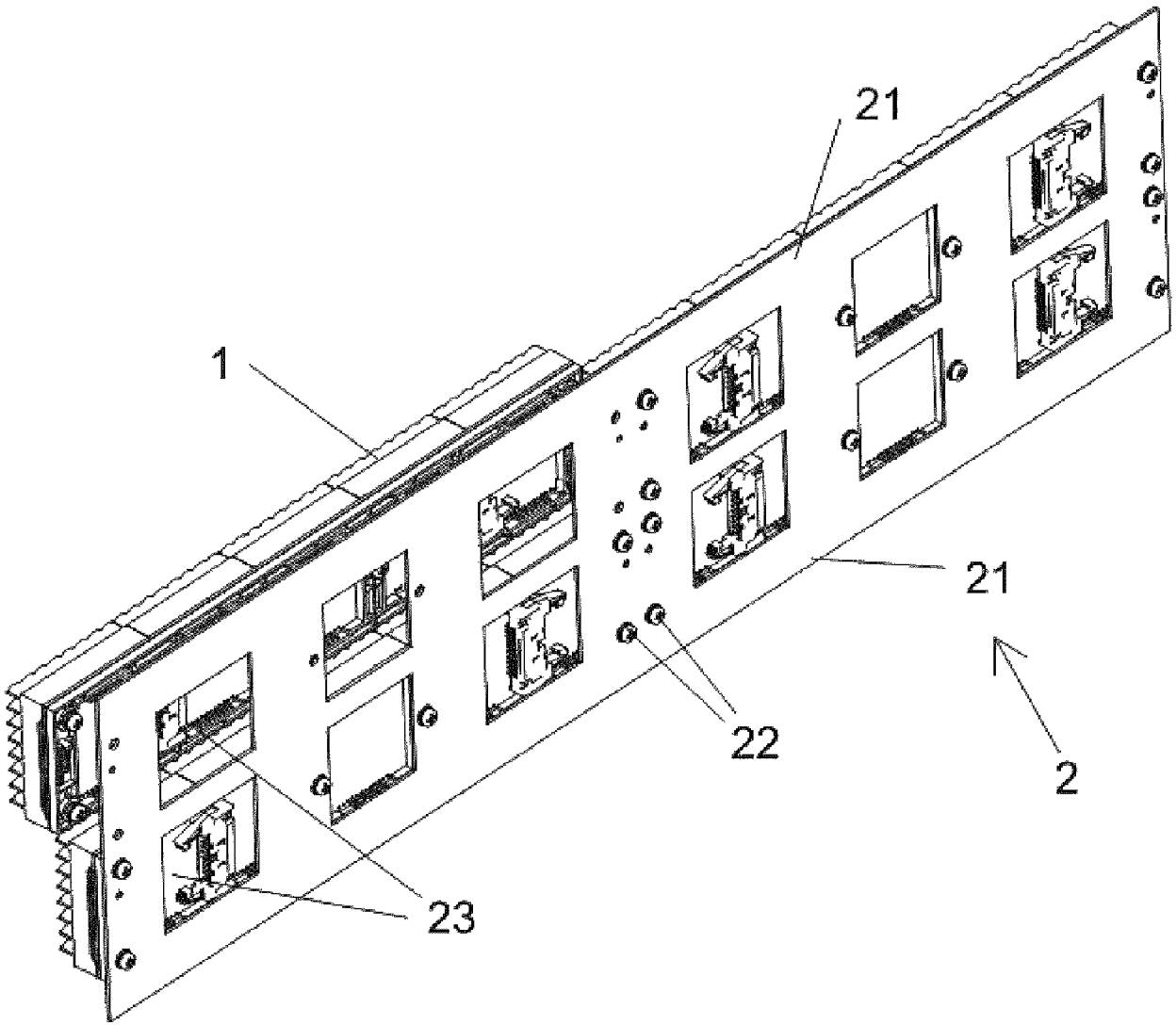
FIG. 4B is a back perspective view of the main board of the LED display screen assembly when assembling according to the first preferred embodiment of the present invention.
Figure 4C:
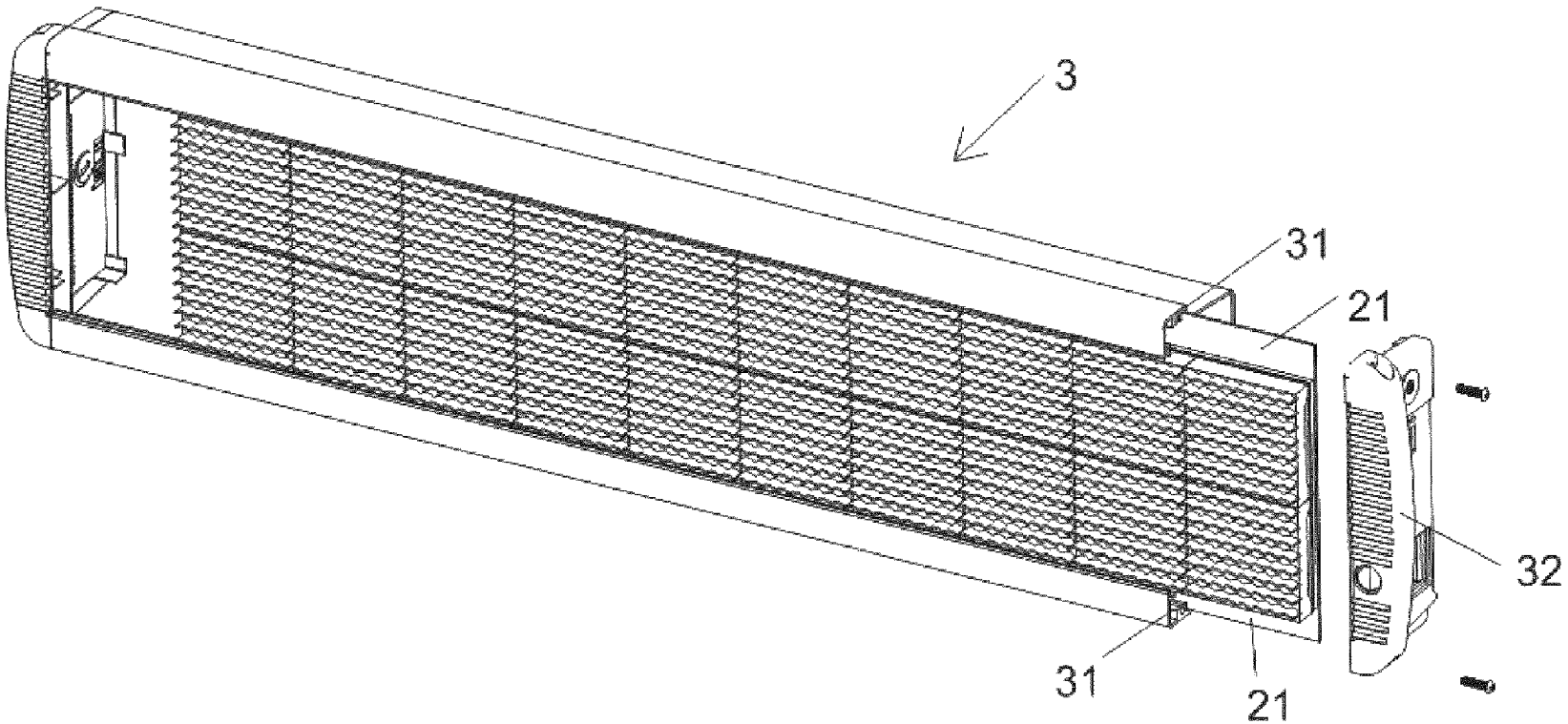
FIG. 4C is a perspective view of the LED display screen assembly when assembling according to the first preferred embodiment of the present invention.

Referring to FIG. 4A-4C of the drawings, the LED display screen assembly is assembled to form a large united display screen. The LED display units 12 mount on the main board 2 in formation, and then is inserted into the case 3 to form a LED display screen of plural lines and rows.

The present invention also provides a method of assembling a LED display screen, comprising:

mounting a PCB driving board 13 on a supporting base 14;

mounting a LED display unit 12 on the supporting base 14 and has the PCB driving board 13 therebetween;

electrically connecting the LED display unit 12 and the PCB driving board 13 to form a LED display module 1;

mounting a plurality of LED display modules 1 on a main board 2 in formation to form a united display screen; and then receiving the main board 2 into a case 3 to expose the united display screen.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A LED display screen assembly, comprising:

a case having a front surface having a window, a rear surface, and an opening provided between said front surface and said rear surface;

a main board for inserting into said case via said opening, having a front surface for displaying via said window; and a plurality of LED display modules each comprising a LED display unit for illuminating, a PCB driving board electrically connecting with said LED display unit, and a supporting base for mounting on said main board, wherein said PCB driving board mounts on said supporting base, said LED display unit mounts on said supporting base and holds said PCB driving board therebetween, wherein said LED display modules mount on said front surface of said main board in formation to form a united display screen, wherein said PCB driving board has a controlling port provided on an opposite side to said LED display unit and electrically connecting with said LED display unit to provide electric power and control a working of said LED display unit, wherein said PCB driving board has a plurality of first holes provided along edge portions thereof, said supporting base has a plurality of second holes corresponding to said first holes, said main board has a plurality of third holes corresponding to said second holes, said LED display unit further comprises a plurality of first bolts corresponding to said first holes, said second holes and said third holes, said first bolts insert through said first holes, said second holes and said third holes to combine said PCB driving board, said supporting base and said main board up, wherein said LED display unit further comprises a plurality of buffers mounting besides said first bolts, and between said PCB driving board and said supporting base, so as to reduce pressure force therebetween when fastening said first bolts, and protect said PCB driving board from being damaged.

2. The LED display screen assembly, as recited in claim 1, wherein said supporting base further comprises a first bridge mounting on a central portion thereof, said first bridge reserves two blank areas respectively on two sides thereof, said main board has corresponding blank windows for overlapping with said blank areas to expose said controlling port to outer devices, said first bridge strengthens said supporting base to prevent transformation, so as to provide a flat and stable supporting base.

3. The LED display screen assembly, as recited in claim 1, wherein said supporting base has a plurality of fourth holes provided evenly in a middle portion and along two prolonged edges thereof, said supporting base further comprises a plurality of second bridges mounting evenly in a middle portion and along two prolonged edges thereof, said second bridges has a plurality of fifth holes corresponding to said fourth holes, said LED display unit further comprises a plurality of second bolts corresponding to said fourth holes and said fifth holes, said second bolts insert through said fourth holes and said fifth holes to combine said PCB driving board and said supporting base up, therefore, said second bolts fasten said PCB driving board and said supporting base from a heart thereof.

4. The LED display screen assembly, as recited in claim 1, wherein said supporting base has a plurality of fourth holes provided evenly in a middle portion and along two prolonged edges thereof, said supporting base further comprises a plurality of second bridges mounting evenly in a middle portion and along two prolonged edges thereof, said second bridges has a plurality of fifth holes corresponding to said fourth holes, said LED display unit further comprises a plurality of second bolts corresponding to said fourth holes and said fifth holes, said second bolts insert through said fourth holes and said fifth holes to combine said PCB driving board and said supporting base up, therefore, said second bolts fasten said PCB driving board and said supporting base from a heart thereof.

5. The LED display screen assembly, as recited in claim 4, wherein said second bridge reserves blank areas respectively therebetween, said main board has corresponding blank windows for overlapping with said blank areas to expose said controlling port to outer devices, said second bridge strengthens said supporting base to prevent transformation, so as to provide a flat and stable supporting base.

6. The LED display screen assembly, as recited in claim 2, wherein said main board has two guiding edge portions respectively provided on two opposite sides, said case has two guiding grooves respectively provided on two opposite sides beside said opening and between said front surface and said rear surface of said case, said main board is received into said case by inserting said guiding edge portions along said guiding grooves via said opening, said guiding grooves hold said guiding edge portions to mount said main board inside said case.

7. The LED display screen assembly, as recited in claim 5, wherein said main board has two guiding edge portions respectively provided on two opposite sides, said case has two guiding grooves respectively provided on two opposite sides beside said opening and between said front surface and said rear surface of said case, said main board is received into said case by inserting said guiding edge portions along said guiding grooves via said opening, said guiding grooves hold said guiding edge portions to mount said main board inside said case.

8. The LED display screen assembly, as recited in claim 6, wherein said case further comprises a retaining member corresponding to said opening, said retaining member mounts on said opening after inserting said main board into said case to retain said main board inside said case.

9. The LED display screen assembly, as recited in claim 7, wherein said case further comprises a retaining member corresponding to said opening, said retaining member mounts on said opening after inserting said main board into said case to retain said main board inside said case.

10. The LED display screen assembly, as recited in claim 8, wherein said main board is preferably made of aluminium alloy, such that said main board is easy to be manufactured to meet different requirements, besides, a weight of said main board is reduced, and said main board resists rust.

11. The LED display screen assembly, as recited in claim 9, wherein said main board is preferably made of aluminium alloy, such that said main board is easy to be manufactured to meet different requirements, besides, a weight of said main board is reduced, and said main board resists rust.

12. The LED display screen assembly, as recited in claim 10, wherein said supporting base is made of plastic, so as to protect said LED display units and said PCB driving board.

13. The LED display screen assembly, as recited in claim 11, wherein said supporting base is made of plastic, so as to protect said LED display units and said PCB driving board.

14. The LED display screen assembly, as recited in claim 12, wherein said LED display module further comprises a transparent LED shade covering on said LED display unit to protect said LED display unit from rain, dust or wind.

15. The LED display screen assembly, as recited in claim 13, wherein said LED display module further comprises a transparent LED shade covering on said LED display unit to protect said LED display unit from rain, dust or wind.

* * * * *